United States Patent [19]

Yamaguchi

[11] Patent Number: 4,893,982

[45] Date of Patent: Jan. 16, 1990

[54] APPARATUS FOR CONVEYING WORKPIECE

[75] Inventor: Takaharu Yamaguchi, Toyokawa, Japan

[73] Assignee: Taiho Seiki Co., Ltd., Toyota, Japan

[21] Appl. No.: 138,727

[22] Filed: Dec. 28, 1987

[30] Foreign Application Priority Data

Sep. 17, 1987 [JP] Japan ..... 62-233321
Sep. 17, 1987 [JP] Japan ..... 62-233322

[51] Int. Cl.[4] ..... B65G 65/08

[52] U.S. Cl. ..... 414/753; 294/115; 414/749

[58] Field of Search ..... 414/265, 282, 373, 648, 414/661, 749, 753, 226; 198/468.2; 294/86.41, 115

[56] References Cited

U.S. PATENT DOCUMENTS

| | | | |
|---|---|---|---|
| 3,556,315 | 1/1971 | Berger | 414/753 X |
| 3,587,872 | 6/1971 | Pauly | 294/86.41 X |
| 3,854,889 | 12/1974 | Lemelson | 198/465.1 |
| 4,283,165 | 8/1981 | Vertut | 901/1 X |
| 4,507,044 | 3/1985 | Hutchins et al. | 414/749 X |
| 4,607,997 | 8/1986 | Asano | 414/667 |
| 4,664,590 | 5/1987 | Maekawa | 901/6 X |
| 4,727,976 | 3/1988 | | 198/403 |
| 4,744,596 | 5/1988 | Hiller et al. | 294/115 X |
| 4,754,863 | 7/1988 | | 198/339.1 |

FOREIGN PATENT DOCUMENTS

| | | | |
|---|---|---|---|
| 0231932 | 1/1986 | German Democratic Rep. | 901/1 |
| 58-134233 | 9/1983 | Japan . | |
| 58-147636 | 10/1983 | Japan . | |
| 58-183511 | 10/1983 | Japan . | |

*Primary Examiner*—Robert J. Spar
*Assistant Examiner*—Donald W. Underwood
*Attorney, Agent, or Firm*—Sandler & Greenblum

[57] ABSTRACT

An apparatus for conveying a workpiece comprising workpiece clamping means for clamping, releasing and rotating the workpiece, clamp reversing means operable from outside for moving the workpiece clamping means between a clamping position and a releasing position, workpiece holders which reciprocally move between a workpiece receiving position and a workpiece discharging position, and external actuating means at the workpiece receiving position and the workpiece discharging position, for actuating the clamp reversing means.

31 Claims, 11 Drawing Sheets

APPARATUS FOR CONVEYING WORKPIECE

BACKGROUND OF THE INVENTION

1. Field of the Invention

The present invention relates to an apparatus for conveying a workpiece from a press machine to another press machine.

2. Description of The Related Art

Generally speaking, in a pressing process, workpieces are successively subject to drawing, blank piercing, piercing and bending etc. by a plurality of press machines to produce complete products. Accordingly, it is necessary to convey the workpieces (halfproducts) from a press machine to a subsequent press machine.

There are many known conveying apparatuses for automatically conveying the workpieces between the press machines. It is often necessary to turn the workpieces upside down when they are conveyed from one press machine to a subsequent press machine. Accordingly, the conveying apparatus usually has a station in which workpieces which are discharged from a die frame of a press machine by means of an unloader are received, a station in which the workpieces received by the receiving station are turned upside down, a station in which the turned workpieces are conveyed, and a station in which the conveyed workpieces are transferred to another unloader. Each station needs a workpiece receiver etc.

In a known conveying apparatus in which a workpiece is located on a workpiece receiver or a carriage, the operations at the respective stations are individually effected in a stepped fashion, resulting in a long time needed to carry the workpieces. In addition to the foregoing, since each station has a tool, such as a workpiece receiver, it is necessary to exchange the tools of all of the stations in order to convey different types of workpieces, resulting in an increased amount of labor and time for the exchange operation.

To solve the problem mentioned above, there is also known a workpiece conveying apparatus which has clamps holding the workpieces, so that the workpieces are turned upside down and conveyed by the clamps. However, in this type of conveying apparatus, since the clamp is usually actuated by a hydraulic cylinder device, a pressurized fluid source for working the cylinder device, conduits for connecting the cylinder device to the pressurized fluid source, valves for controlling the fluid connection, and conductive cables or the like connected to the cylinder device are needed.

These conduits and the cables are moved together with the operation of the cylinder device, so that legs of an operator or another machine may be caught by the conduits or the cables, which is dangerous. Furthermore, when the conduits or the cables catch operator's legs or another machine, the conduits or the cables can be cracked or partially broken, resulting in a leakage of the fluid.

SUMMARY OF THE INVENTION

The primary object of the present invention is to provide an apparatus for conveying workpieces, in which steps of conveyance operation successively take place in parallel at a high speed.

The secondary object of the present invention is to provide a conveying apparatus in which conduits or electrical cables are not moved together with the displacement of the hydraulic device.

Another object of the present invention is to provide a compact and simple apparatus for conveying workpieces having a decreased number of components.

To achieve the object of the invention mentioned above, according to the present invention, there is provided an apparatus for conveying a workpiece, comprising at least one guide rail located between a workpiece receiving position and a workpiece discharging position, carriers which can reciprocally move on the guide rail, drive means for reciprocally moving the carriers along the guide rail, workpiece holders supported on the carriers having rotational shafts, workpiece clamping members which are supported by the rotational shafts of the workpiece holders and which move between a workpiece holding position and a workpiece releasing position, control means for controlling the rotation of the rotational shafts of the workpiece holders, and reversing means for transferring the workpiece clamping members between the workpiece holding position and the workpiece releasing position at the workpiece receiving position and the workpiece discharging position of the guide rail.

According to another aspect of the present invention, there is provided a workpiece conveying apparatus having workpiece holders which can move between a workpiece receiving position and a workpiece discharging position and which have workpiece clamping members which can selectively occupy a workpiece holding position and a workpiece releasing position, wherein each of said workpiece holder comprises a clamp reversing member operable from the outside for moving the clamping member between the workpiece clamping (holding) position and the workpiece releasing position, and outside actuating means for actuating the clamp reversing member of the workpiece holder which comes to the workpiece receiving position and the workpiece discharging position, at the workpiece receiving position and the workpiece discharging position, respectively.

BRIEF DESCRIPTION OF THE DRAWINGS

The invention will be described below in detail with reference to the accompanying drawings, in which.

DESCRIPTION OF PREFERRED EMBODIMENTS

Figure 1:
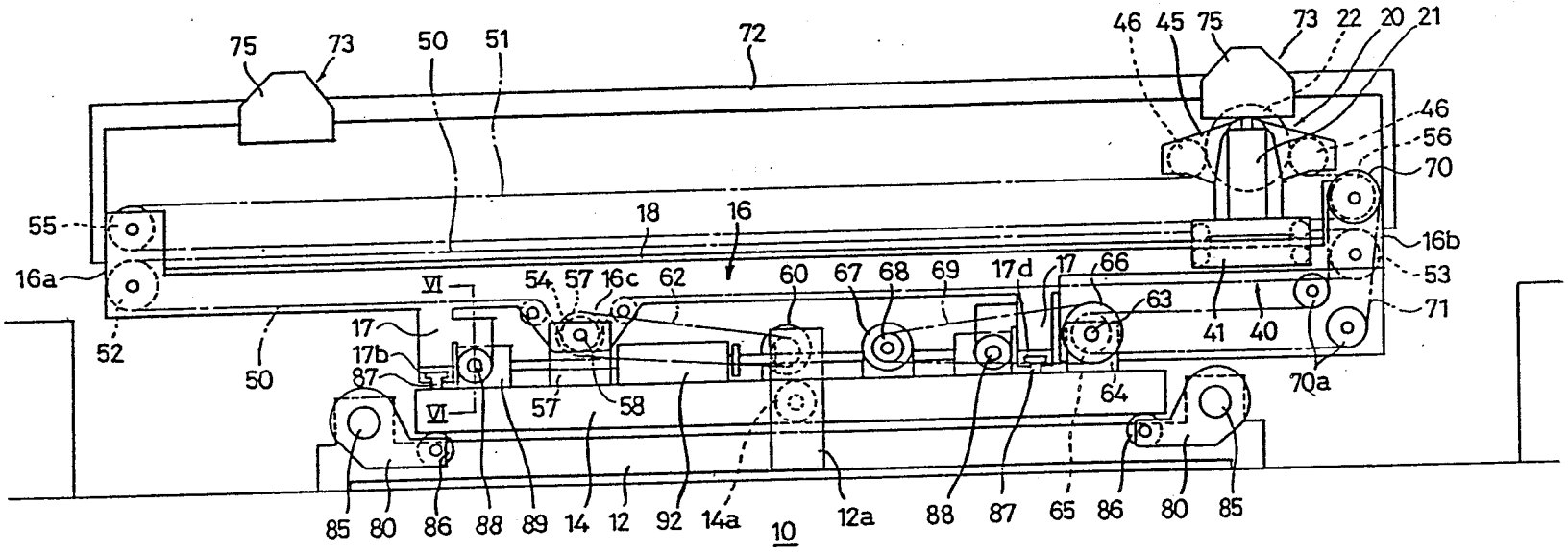
FIG. 1 is a front elevational view of a main part of a workpiece conveying apparatus according to the present invention.

The workpiece conveying apparatus according to the present invention has a stationary frame 12 provided on a base 10, an elevating frame 14 which is connected to the stationary frame 12 by means of a linkage, two guide rail supporting frames 16 which are provided on the elevating frame 14 and which extend in a direction parallel with the direction O of the conveyance of the workpiece, guide rails 18 which are secured to the respective guide rail supporting frames 16 and which extend in a direction parallel with the conveyance direction O, workpiece holders 20 which are provided on the respective guide rails 18 and which have workpiece clamping members for holding the workpieces W, belt drive mechanisms for rotating the clamping members, carriers 40 for moving the workpiece holders 20 along the guide rails 18, and belt drive mechanisms which reciprocally move the carriers.

First, the work holders 20 which hold the workpieces W will be explained below in detail with reference to FIGS. 4A and 4B.

Each workpiece holder 20 has a frame 21 which has a toothed pulley 22 connected thereto by a hollow shaft 23 extending in a horizontal direction. The hollow shaft 23 is integral with the toothed pulley 22 and is rotatably supported by the frame 21 through bearings 24, 24. The hollow shaft has at its one end (right end) a supporting plate 25 secured thereto which has at its front end a pair of clamp arms 26, 26 which clamp the workpiece W and which are rotatably connected to the supporting plate 25.

In the hollow portion of the hollow shaft 23 is slidably inserted a first clamp shaft 27 which has at its front end (right end) bifurcated arms **27*a*. The bifurcated arms 27*a* are functionally connected to the clamp arms 26 by means of connecting plates 28 to form a toggle joint in which the first clamp shaft 27 is a driver (link). To the front ends 26*a* of the clamp arms 26 can be attached various tools (not shown) for holding the workpiece W. In the hollow portion of the hollow shaft 23 is slidably inserted a second clamp shaft 29 from the left end thereof, so that the second clamp shaft 29 is connected to the first clamp shaft 27 through a coil spring 30**.

The elements mentioned above form a workpiece clamping mechanism for a workpiece holder 20.

To the left end of the frame 21 is secured a supporting plate 31 which extends in parallel with the second clamp shaft 29. The portion of the supporting plate 31 located above the second clamp shaft 29 has a clamp reversing lever 32 pivoted thereto by means of a pivot shaft **32*a* which extends perpendicularly to the second clamp shaft 29. The clamp reversing lever 32 has at its free end a roller 33 and at its lower end a sector gear 34 which is secured to the pivot shaft 32*a*. The sector gear 34 meshes with a spur gear 35 which is supported by the supporting plate 31 by means of a shaft 35*a*. The spur gear 35 has an eccentric roller 36** rotatably connected thereto.

To the portion of the supporting plate 31 located below the second clamp shaft 29 is pivoted a swing lever 37 by means of a shaft 38. The swing lever 37 is provided on its intermediate portion with an elongated hole **37*a* in which the roller 36 is fitted. The swing lever 37 has a roller 39 pivoted to the front end of the swing lever 37. The roller 39 is fitted in an annular groove 29*a* which is formed on the periphery of the second clamp shaft 29**.

Figure 4A:
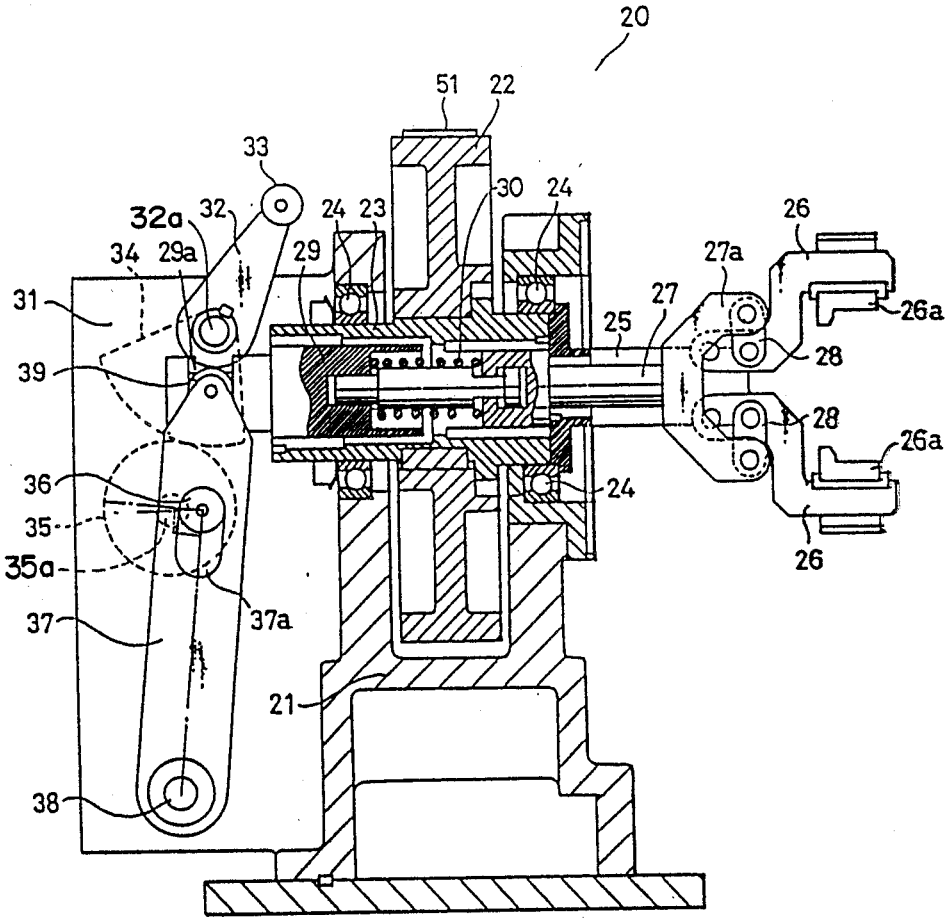
FIG. 4A is an enlarged sectional view of a workpiece holder shown in FIG. 1, at a workpiece holding position in which the workpiece is clamped.

In FIG. 4A which shows a clamping (holding) position in which the workpiece is clamped (held), the axes of the shafts **35*a* of the spur gear 35, of the roller 36 and of the shaft 38 form an angle slightly smaller than 90°, and the spur gear 35 cannot rotate in a direction to decrease the angle. Accordingly, if the swing lever 37 is subject to a force which tends to release the clamp, i.e. a rotational force in a counterclockwise direction in FIG. 4A, the swing lever 37 cannot rotate in that direction. Therefore, if a releasing force is applied to the clamp arms 26** once they clamp the workpiece W, the clamp arms do not open. This corresponds to a workpiece holding (clamping) position.

The workpiece holder 20 operates as follows.

When the clamp reversing lever 32 rotates in a counterclockwise direction from the workpiece holding position shown in FIG. 4A, the swing lever 37 rotates in the same direction through the sector gear 34, the spur gear 35, and the roller 36, so that the second clamp shaft 29 moves in the left hand direction through the roller 38 and the annular groove **29*a***.

Figure 4B:
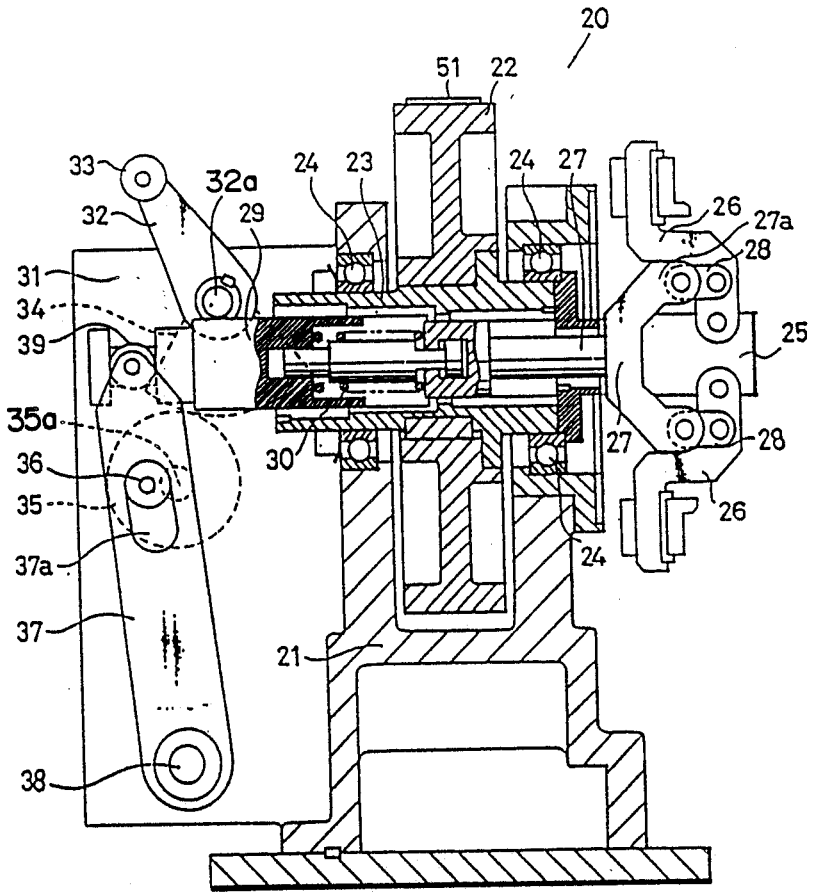
FIG. 4B is an enlarged sectional view of a workpiece holder shown in FIG. 1, at a workpiece releasing position in which the workpiece is released.

The movement of the second clamp shaft 29 causes the first clamp shaft 27 which is connected to the second clamp shaft 29 through the coil spring 30 to move in the left hand direction, so that the clamp arms 26 are moved to open through the connecting plates 28 to release the workpiece, as shown in FIG. 4B. This corresponds to a workpiece releasing position. Note that when the clamp arms 26 open, the front ends **26*a* of the clamp arms 26** come away from each other.

When the clamp reversing lever 32 which is located in the workpiece releasing position rotates in the clockwise direction, the swing lever 37 rotates in the clockwise direction through the sector gear 34, the spur gear 35, and the roller 36, to move the second clamp shaft 29 in the right hand direction through the roller 38 and the annular groove **29*a*. As a result of the movement of the second clamp shaft 29 in the right direction, the first clamp shaft 27 which is connected to the second clamp shaft 29 through the coil spring 30 moves in the same direction to close the clamp arms 26 through the connecting plates 28 thereby to clamp the workpiece W. In this state, the front ends 26*a* of the clamp arms 26** come close to each other.

As can be understood from the foregoing, the clamp reversing lever 32 moves the clamp arms 26, 26 between the clamping position in which the workpeice W is clamped and the releasing position in which the workpiece W is released. This movement between the clamping position and the releasing position is caused by "clamp reversing".

When the toothed pulley 22 rotates, the hollow shaft 23 rotates together therewith, and accordingly the supporting plate 25 secured to the hollow shaft 23 rotates together. Since the supporting plate 25 has the clamp arms 26 pivoted thereto, the clamp arms 26 and accordingly the workpiece W rotate together with the connecting plates 27, the first clamp shaft 27, the coil spring 30, and the second clamp shaft 29 and together with the toothed pulley 29 and the hollow shaft 23.

Figure 2:
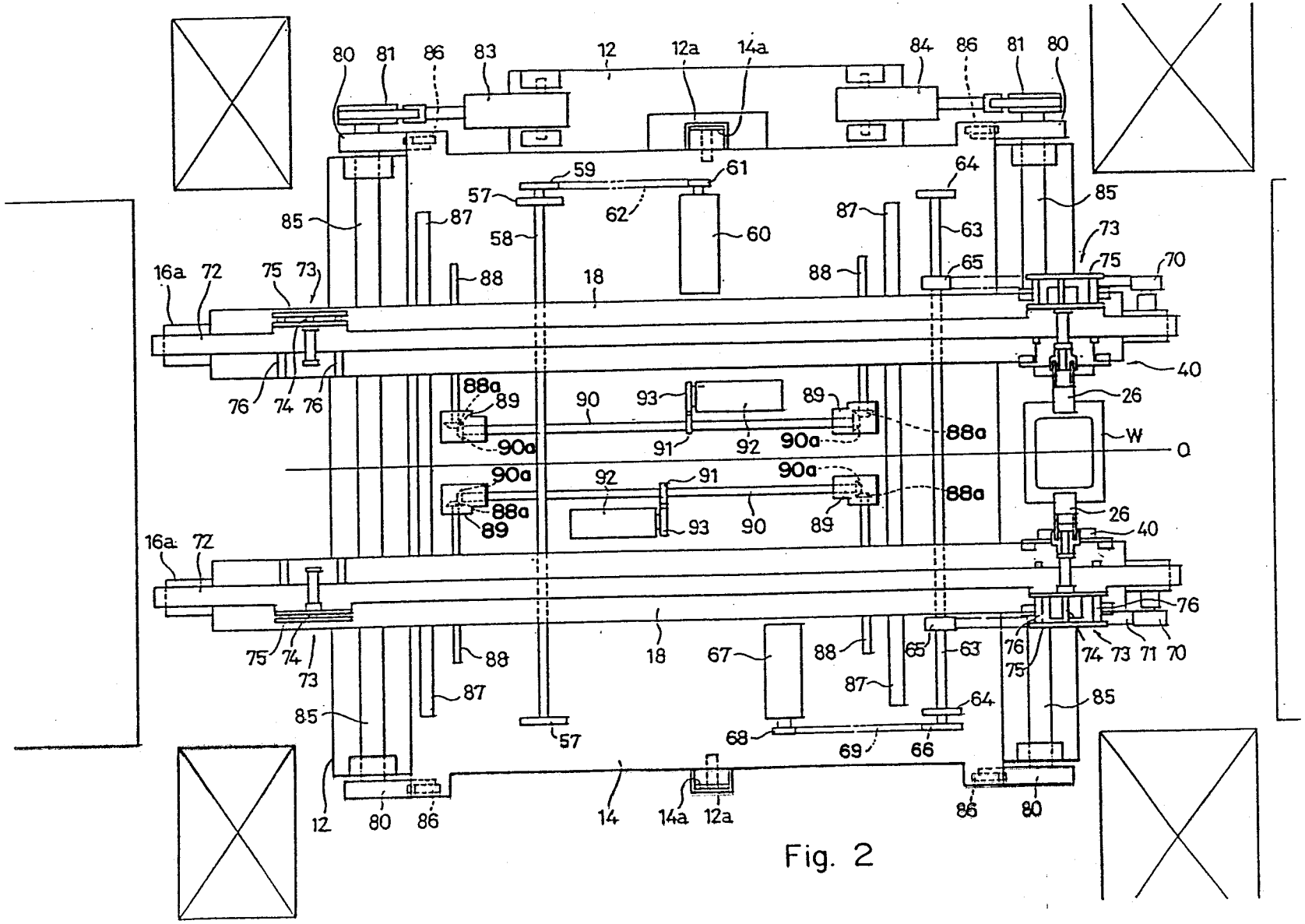
FIG. 2 is a plan view of FIG. 1.
Figure 3:
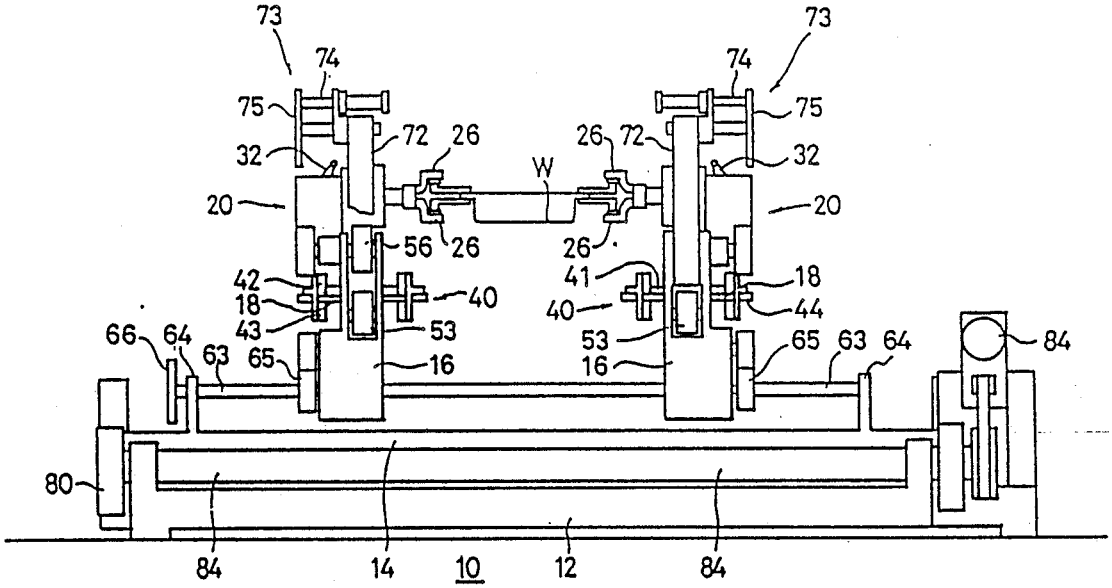
FIG. 3 is a side elevational view of FIG. 1.
Figure 5:
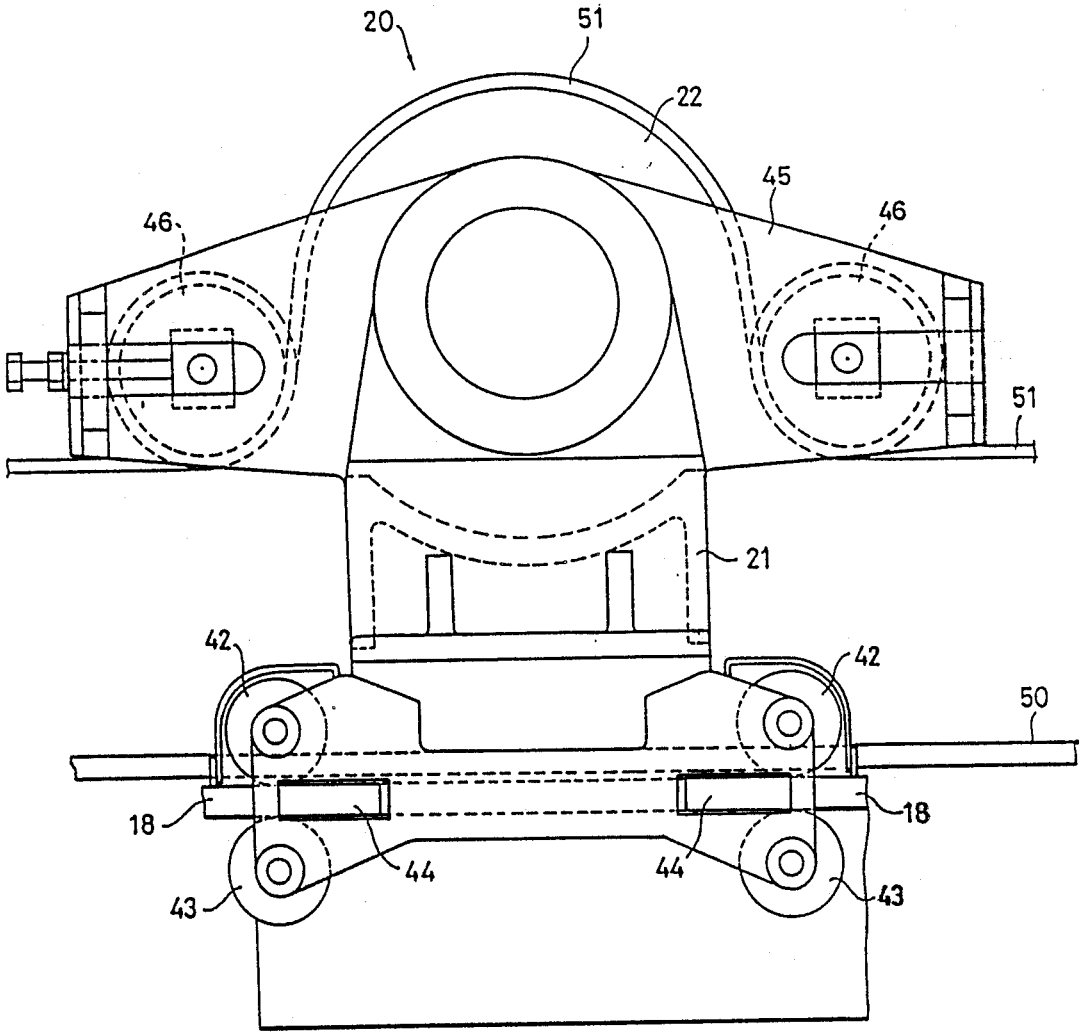
FIG. 5 is an enlarged front elevational view of a carrier shown in FIG. 1.

The workpiece holders 20 are provided on carriages 41 of the carriers 40 which are movably supported on and by a pair of guide rails 18, so that the clamp arms 26 of the holders are opposed to each other, as shown in FIGS. 2 and 3. Each of the carriages 41 has pairs of spaced upper and lower wheels 42 and 43 which hold the associated guide rail 18 therebetween, as can be seen in FIG. 5. In addition to the wheels 42 and 43, each carriage 41 has pairs of spaced right and left wheels 44 which hold the associated guide rail 18 therebetween in the horizontal direction. These wheels ensure that the carriages 41 can steadily move on and along the respective guide rails 18. The carriages 41 have endless timing belts 50 for travelling the carriages.

The frame 21 of each of the workpiece holders 20 has an arm 45 which extends in the right and left directions of the toothed pulley 22 and which has pulleys 46, 46. An additional endless timing belt 51 is wound around the pulleys 46 and the toothed pulley 22.

In FIG. 1, the guide rail supporting frame 16 has at its opposite ends bearing portions **16*a* and 16*b* which project upward therefrom. Also, at the lower portion of the supporting frame 16 that is located slightly left from the center thereof, is provided a bearing portion 16*c* which projects downward. Pulleys 52, 53 and toothed pulley 54 are rotatably supported by the bearing portions 16*a*, 16*b*, and 16*c*, respectively. The timing belt 50 is wound around the pulleys 52, 53 and the toothed pulley 54, so that the timing belt 50 endlessly rotates when the toothed pulley 54** rotates.

A pulley 55 and a pulley 56 are rotatably supported above the pulley 52 and the pulley 53, respectively. The timing belt 51 is wound around the pulleys 55 and 56, so that the timing belt 51 is endlessly rotated by the rotation of the toothed pulley 56.

Figure 6:
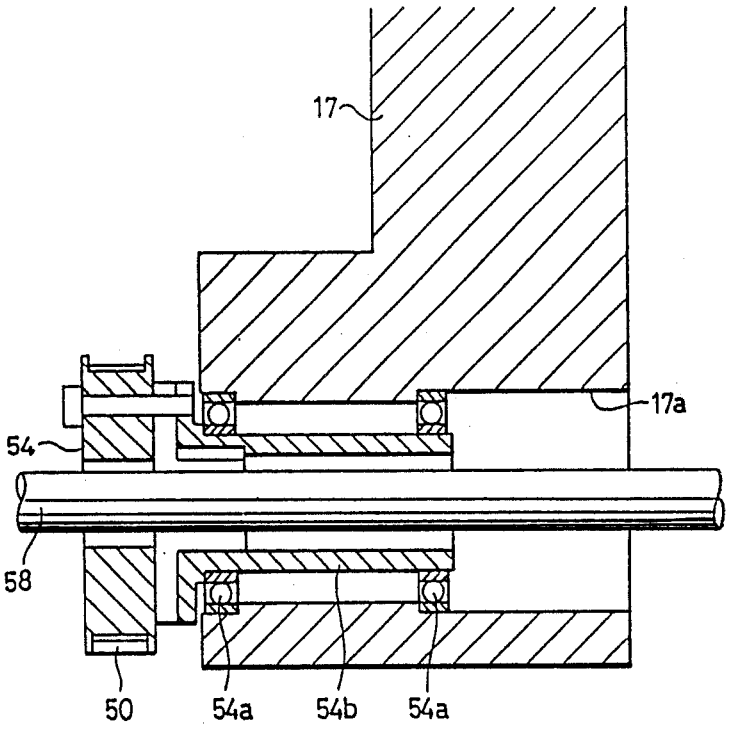
FIG. 6 is an enlarged sectional view taken along the line VI—VI in FIG. 1.

On the portions of the elevating frame 14 that are located on the outside of the toothed pulleys 54 are provided bearing plates 57, 57 projecting upward therefrom, between which a spline shaft 58 is rotatably supported to extend through center bores of the toothed pulleys 54, 54 in a direction perpendicular to the guide rails 18, as shown in FIG. 2. The toothed pulleys 54 are secured to hollow shafts **54*b* which are rotatably inserted in axial bores 17*a* of legs 17 through bearings 54*a*, as shown in FIG. 6, so that the toothed pulleys 54 are spline-engaged by the spline shafts 58. The spline shafts 58 are axially movable relative to the toothed pulleys 54 and can rotate together with the pulleys 54**.

To one end of the spline shaft 58 which projects from one of the bearing plates 57 is secured a toothed pulley 59, as shown in FIG. 2. A drive motor 60 for driving the carriers is provided on the elevating frame 14 in the vicinity of the toothed pulley 59 and has an output shaft **60*a* to which a toothed pulley 61 is secured. The toothed pulleys 59 and 61 are connected by a belt 62, so that when the motor 60 rotates, the spline shaft 58 is rotated through the toothed pulley 61, the belt 62 and the toothed pulley 59. As a result, the toothed pulleys 54 rotate together to endlessly rotate the timing belts 50** at the same speed.

In FIG. 2, there is provided a spline shaft 63 which extends in parallel with the spline shaft 58 and which is located slightly right from the center of the apparatus when viewed from above. The spline shaft 63 is rotatably supported by bearing plates 64 which are provided on the elevating frame 14.

To the opposite sides of a pair of guide rail supporting frames 16 are rotatably mounted toothed pulleys 65 similar to the toothed pulleys 54, so that the spline shaft 63 extends through the center holes of the toothed pulleys 65. The lower end (FIG. 2) of the spline shaft 63 which projects from the associated bearing plate 64 has a toothed pulley 66 secured thereto. A motor 67 for rotating the workpiece W is provided on the elevating frame 14, in the vicinity of the toothed pulley 66. To the output shaft **67*a* of the motor 67 is secured a toothed pulley 68 which is connected to the toothed pulley 65 by means of a belt 69**.

The toothed pulleys 56 are connected to toothed pulleys 70 coaxial thereto so as to rotate together. The toothed pulleys 70 are connected to the respective toothed pulleys 65 by means of belts 71 through intermediate guide pulleys **70*a*, so that when the motor 67 rotates, the toothed pulleys 65 are rotated through the toothed pulleys 68, the belt 69 and the spline shaft 63 to rotate the toothed pulleys 56 through the belts 71 and the toothed pulleys 70. As a result, the rotating timing belts rotate to rotate the toothed pulleys 22, and, accordingly, the clamp arms 26** and the workpiece W.

The opposite ends of each of the guide rail supporting frames 16 are connected to each other by a mounting frame 72 which bridges the opposite ends of the guide rail supporting frame 16. To the mounting frames 72 are mounted external actuating members 73 which are located in the vicinity of the opposite ends of the associated frames 72 to push the clamp reversing levers 32 of the workpiece holders 20 in order to open and close the clamp arms 26.

Each actuating member 73 has a hydraulic cylinder device with a piston rod 74 and a pressure plate 75 which is secured to the front end of the piston rod 74. The pressure plate 75 is guided by two parallel guide bars 76. In FIGS. 1 and 2, the two left actuating members 73 are located in an inoperative position in which the piston rods 74 are retracted, and the two right actuating members 73 are located in an inoperative position in which &he piston rods 74 are extended.

In this inoperative position, when the workpiece holders 20 come to the right extremities, the rollers 33 come between the frames 72 and the pressure plates 75 (FIG. 3). When the piston rods 74 are retracted, the rollers 33 come into abutment with the pressure plates 75 to rotate the clamp reversing levers 32 toward the operative position, i.e. in the clockwise direction in FIG. 4B. This results in the closure of the clamp arms 26 to clamp the workpiece W (FIG. 4A).

On the contrary, when the workpiece holders 20 come to the left extremity, the rollers 33 come outside the pressure plates 75. In this state, when the piston rods 74 project, the pressure plates 75 come into abutment with the rollers 33 to rotate the clamp reversing levers 32 toward the direction of release of the workpiece, i.e. in the counterclockwise direction in FIG. 4A. As a result of this, the clamp arms 26 open to release the workpiece W. It will be understood from the foregoing operations that the right extremity of the workpiece holders 20 corresponds to a workpiece receiving position and the left extremity thereof corresponds to a workpiece discharging position.

The following discussion will be directed to an adjustment mechanism of the apparatus.

The stationary frame 12 has four legs at four corners thereof. The frame 12 has generally U-shaped posts **12*a* which are provided on the central outside portions of the frame 12 and which have openings opposed to each other. The posts 12*a* extend upward, in FIG. 1**.

The elevating frame 14 is in the form of a plate and has rollers **14*a* which are engaged in the posts 12*a* and which are provided on the central outside portions of the frame 14, so that the rollers 14*a* roll in the corresponding posts 12*a* up and down. Namely, the elevating frame 14 can move up and down and can be inclined in the right and left directions about the rollers 14a, with respect to the stationary frame 12. The upward and downward movements and the inclination of the elevating frame 14 is effected by lifters provided on the four corner portions of the stationary frame 12. Each lifter has a lifting arm 80 which is connected to the frame 12 by means of a horizontal shaft, hydraulic cylinder devices 83 and 84 which are connected to the right and left lifting arms 80 by means of crank mechanisms 81 to rotate the lifting arms 80, and connecting rods 85, each connecting a pair of lifting arms 80 which are opposed with respect to the direction O of the conveyance. Each lifting arm 80 has at its front end a roller 86 which bears against the bottom surface of the associated guide rail supporting frame 16. Accordingly, when the hydraulic cylinder devices 83 and 84 operate, pairs of lifting arms 80 rotate together, so that the rollers 86 roll on the bottom surfaces of the supporting frames 16 to lift the latter. By adjusting the displacement of the hydraulic cylinder devices 83 and 84, it is possible to control the height of the elevating frame 14 while keeping it horizontal and to optionally incline the elevating frame 14** with respect to the horizontal direction. Namely, it is possible to adjust the height of the workpiece receiving position and the workpiece discharging position.

On the elevating frame 14 are provided two parallel rails 87, 87 which are spaced from one another in the right and left directions and which extend perpendicularly to the direction O of the conveyance of the workpiece W.

Each guide rail supporting frame 16 is in the form of a column which extends in parallel with the conveyance direction O and which has at its lower face the legs 17 mentioned above which are spaced from one another at a distance corresponding to the distance of the rails 87, 87. Each leg 17 has at its bottom a channeled member 17b in which the associated rail 87 is slidably fitted. Accordingly, a pair of guide rail supporting frames 16 can move away from and close to each other, along the rails 87.

Furthermore, each leg 17 has a feed screw 88 which is screw-engaged therein and which extends in parallel with the rails 87. The inner ends of the feed screws 88 are inserted in gear boxes 89 secured on the elevating frame 14. Two pairs of gear boxes 89, 89, each pair having gear boxes spaced from one another in the conveyance direction O have connecting shafts 90, 90, so that the gear boxes in each pair are connected to the connecting shaft 90 which is provided, on its opposite ends, with bevel gears 90a which can be engaged by the corresponding bevel gears 88a provided on the inner ends of the feed screws 88 in the gear boxes 89, as shown in FIG. 2.

The connecting shafts 90 have at their intermediate portions gears 91 secured thereto which are engaged by gears 93 which are secured to the output shafts of guide rail moving motors 92 located on the elevating frame 14. With this arrangement, when the guide rail moving motors 92 operate, the feed screws 88, 88 rotate through the gears 93, the gears 91, the shafts 90, and the gear boxes 89, so that the guide rail supporting frames 16 come away from and close to each other along the rails 87 while keeping the frames 16 parallel with the conveyance direction O to adjust the distance between the workpiece holders 20.

The apparatus of the illustrated embodiment operates as follows. The workpieces W are conveyed from the right toward the left in FIGS. 1 and 2. It is supposed that an unloader and a press machine are provided on the right side of the conveyance apparatus, and another unloader and another press machine are provided on the left side of the apparatus, though not shown.

When the workpiece holders 20 are located in the workpiece receiving positions, the clamp arms 26 are opened and the pressure plates 75 are located outside the rollers 33 (left side in FIG. 4B) to prepare for clamp of the workpiece W. In this waiting position, the workpiece W which has been pressed by the press machine is conveyed by the unloader toward between the clamp arms 26.

When the workpiece W comes between the clamp arms 26, the piston rods 74 are retracted, so that the pressure plates 75 come into press contact with the rollers 33 to rotate the clamp revering levers 32 inward, i.e. in the clockwise direction in FIG. 4B. As a result of this, the spur gears 35 rotate in the counterclockwise direction in FIG. 4B, to rotate the swing levers 37 in the clockwise direction. Consequently, the second clamp shafts 29 move toward the clamping direction to press the first clamp shafts 27 through the coil springs 30. As a result, the clamp arms 26 rotate to close. Thus, the workpiece W can be held by tools (not shown) which are provided on the front ends 26a of the clamp arms 26.

The piston rods 74 which are retracted are then extended to separate the pressure plates 75 from the rollers 33. However, since the swing levers 37 cannot rotate in the counterclockwise direction because of the engagement between the rollers 36 and the spur gears 35, the clamp arms 26 which are elastically biased by the coil springs 30 continue holding the workpiece W to maintain the clamping position.

When the pressure plates 75 separate from the rollers 33, the carrier driving motor 60 and the workpiece rotating motor 67 rotate, so that the timing belts 50 and 51 endlessly moves to move the carriers 40 in the left direction along the guide rails 18. The speeds of the endless rotation of the timing belts 50 and 51 vary in accordance with whether or not the workpiece should be turned upside down and with the rotational angle of the workpiece when it should be turned. For instance, when the workpiece W need not turn, speed, time and displacement of the movement of the timing belts 50 can be identical to those of the timing belts 51, so that there is no relative displacement between the timing belts 50 and 51. This results in a maintenance of the posture of the workpiece during the conveyance thereof after it is received.

When the workpiece should be turned upside down by 180° , the speed of the rotating timing belts 51 is smaller than the speed of the movement of the travelling timing belts 50, so that there is a difference in displacement between the timing belts 50 and 51, corresponding to a value half the circumferential length of a pitch circle of the toothed pulleys 22. As a result, it is deemed that the rotating timing belts 51 move by the displacement of half the circumferential length mentioned above, relative to the travelling timing belts 50, so that the toothed pulleys 22 rotate by half one turn, i.e. 180°, to turn the clamp arms 26 and the workpiece W by 180°. Namely, the workpiece W is turned upside down. Note that the time at which the speed of the rotating timing belts 51 changes with respect to the speed of the travelling timing belts 50 can be optionally selected. For example, the change takes place at the intermediate displacement of the timing belts 51 or the change gradually and successively occurs during the displacement thereof.

When the workpiece holders 20 come to the workpiece receiving position, the carrier driving motor 60 and the workpiece rotating motor 67 stop, so that the pressure plates 75 come inside the rollers 33, i.e. on the right side of the rollers 33 in FIG. 4A, and a receiver (not shown) of the unloader moves forward to a position in which the receiver receives the workpiece W. After that, the piston rods 74 project to press the pressure plates 75 against the rollers 33 in order to rotate the clamp reversing levers 32 in the counterclockwise direction in FIG. 4A. Consequently, the swing levers 37 rotate in the counterclockwise direction, to move the second clamp shafts 29 in the clamp releasing direction (left direction in FIG. 4A). The movement of the second clamp shafts 29 in the left direction causes the first clamp shafts 27 which are connected to the second clamp shafts 29 by the coil springs 30 to move in the same direction, so that the clamp arms 26 move to open, thereby to release the workpiece W. This corresponds to the workpiece releasing position, in which the workpiece W is discharged into a receiver of the unloader. After that, the carrier driving motor 60 and the workpiece rotating motor 67 are reversed to bring the workpiece holders 20 back to the right extremity (workpiece receiving position) and the aforementioned operations are repeated to receive the workpiece W from the unloader.

Figure 7:
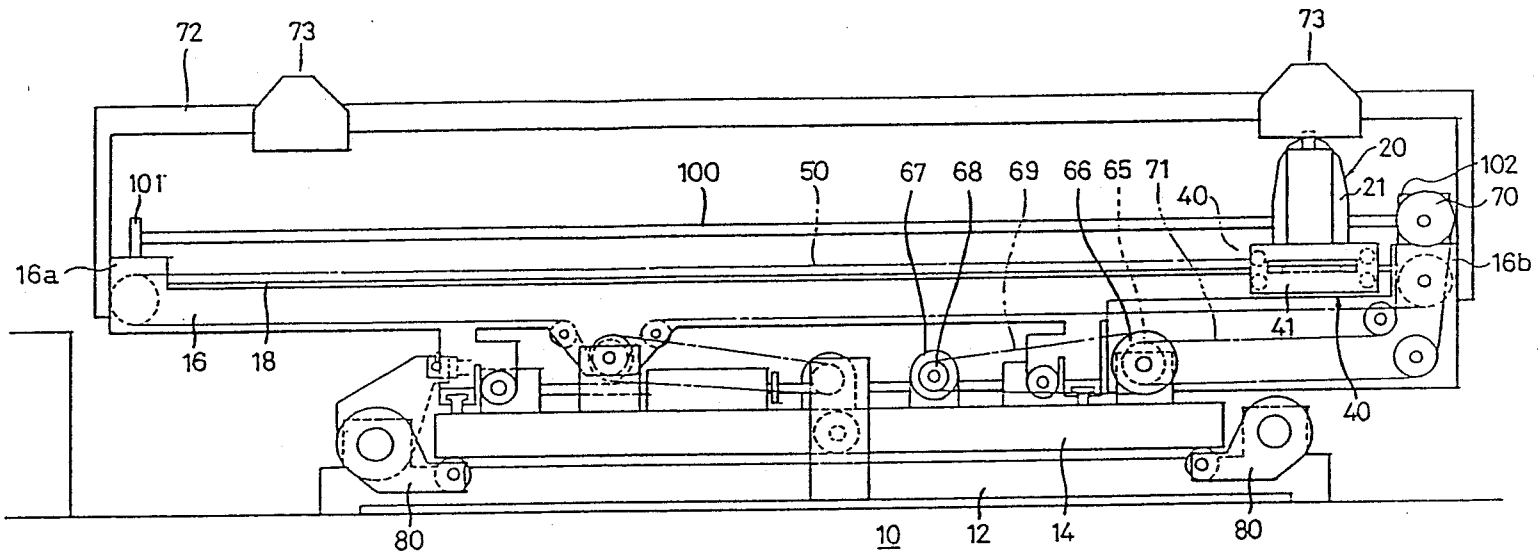
FIG. 7 is a front elevational view of a workpiece conveying apparatus according to another embodiment of the present invention.
Figure 8:
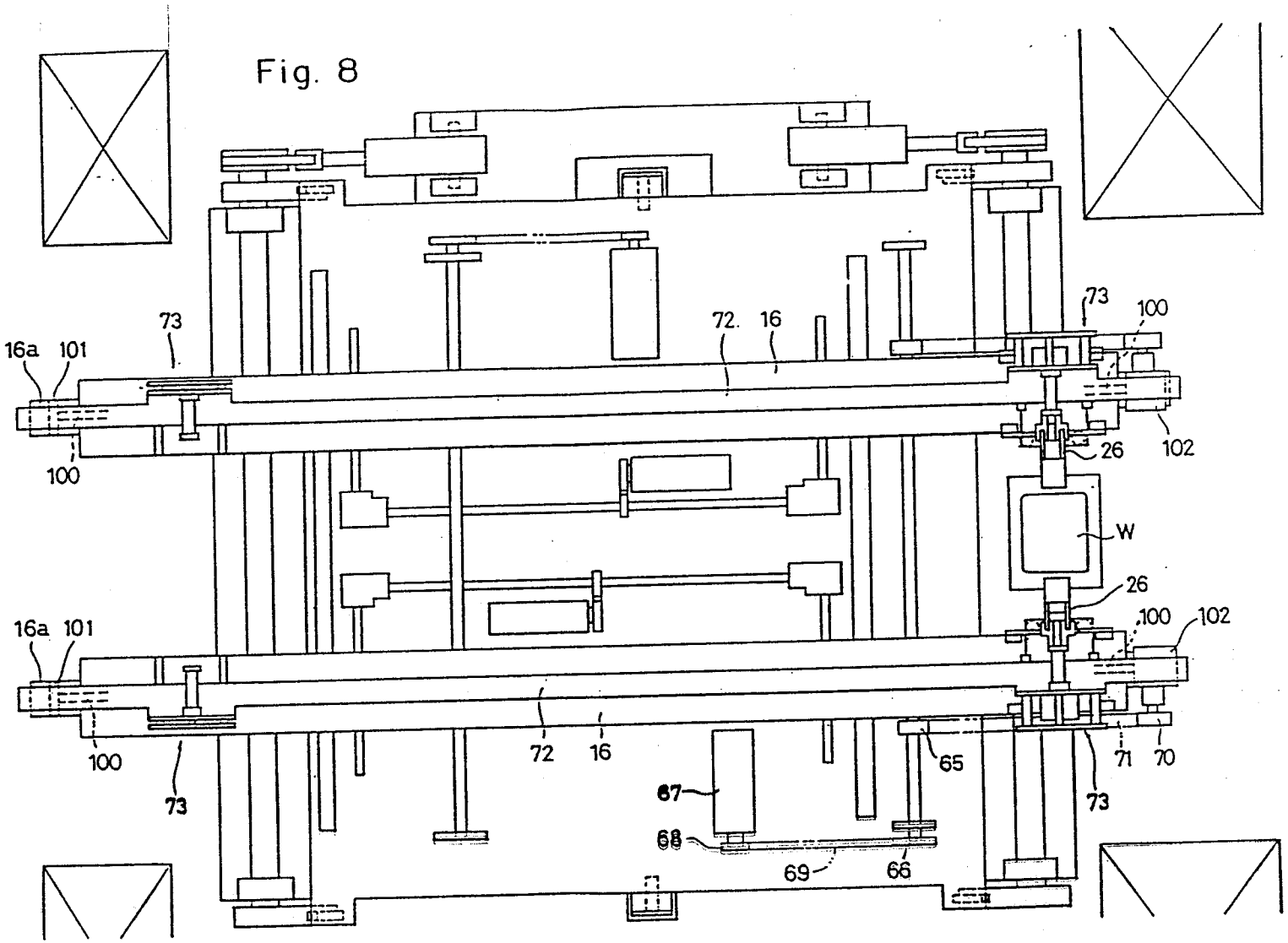
FIG. 8 is a plan view of FIG. 7.
Figure 9:
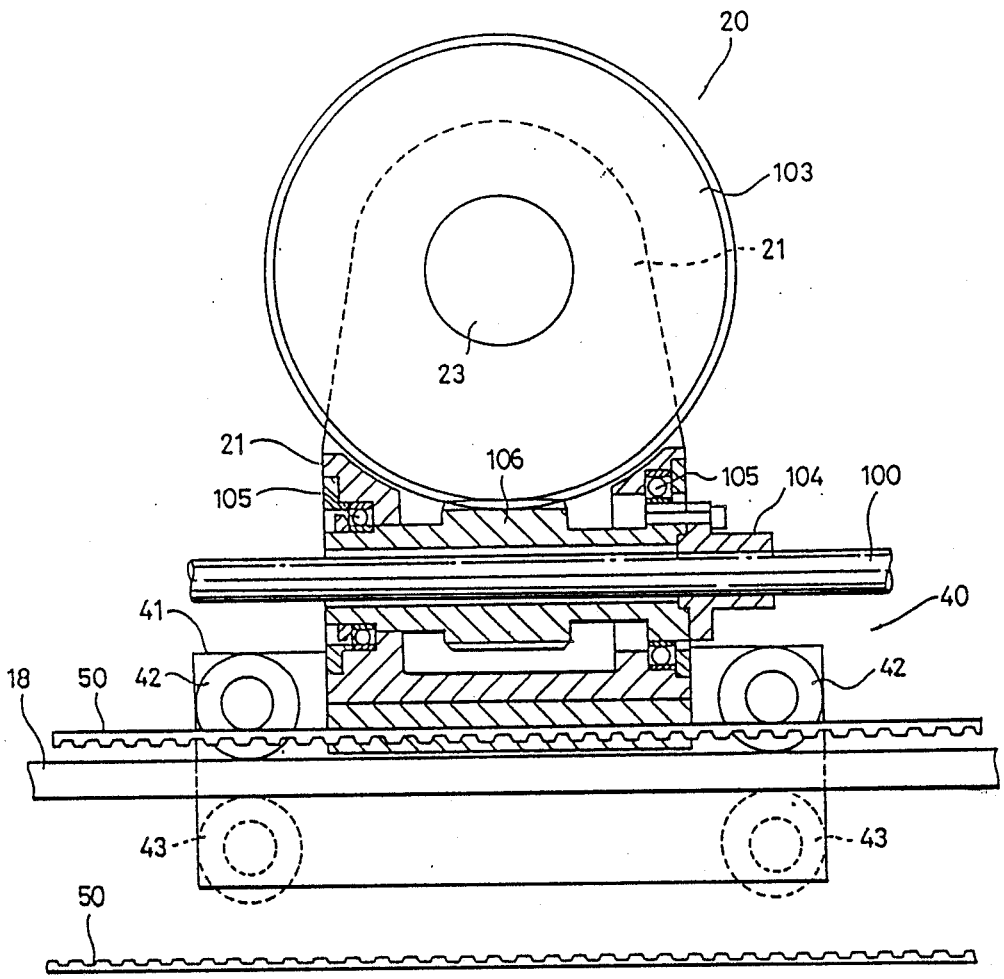
FIG. 9 is an enlarged longitudinal sectional view of a carrier shown in FIG. 7.

FIGS. 7 to 9 show another embodiment of the present invention.

In this modified embodiment, as a drive for rotating the workpiece W are used spline shafts 100. Other construction of the second embodiment is substantially same as that of the first embodiment mentioned above. The elements of the second embodiment corresponding to those of the first embodiment are designated by the same reference numerals as those of the second embodiment.

Each of the spline shafts 100 extends in parallel with the guide rails 18 and is rotatably supported at its one end by a bearing plate 101 secured to the bearing portion **16*a*. The opposite end of each spline shaft 100 is inserted in a gear box 102 provided on the bearing portion 16*b*. The shafts of the toothed pulleys 70 are inserted in the gear boxes 102, so that the spline shafts 100 and the toothed pulleys 70 are functionally connected by bevel gears, similar to the first embodiment. Accordingly, when the workpiece rotating motor 67 rotates, the toothed pulleys 70 rotate through the toothed pulley 68, the belt 69, the toothed pulley 66, the spline shaft 63, the toothed pulleys 65, and the belts 71, so that the spline shafts 100 are rotated through the gear boxes 102**.

Each of the workpiece holders 20 has a gear 103 in place of the toothed pulley 22, as shown in FIG. 9. Below the gears 103, hollow gears 104 are rotatably supported by bearings 105, 105 provided in the frames 21 are spline-engaged by the spline shafts 100. The hollow gears 104 have peripheral teeth 106 which mesh with the gears 103, so that the workpiece holders 20 are moved by the slide contact between the spline shafts 100 and the hollow gears 104. When the spline shafts 100 rotate, the hollow gears 104 rotate together, so that the gears 103 which are engaged by the hollow gears 104 rotate. The rotation of the gears 103 causes the clamp arms 26 to rotate to rotate the workpiece W. Note that the speed and time of the rotation of the spline shafts 100 can be optionally determined.

In the illustrated embodiment, two pairs of workpiece holders 20 are opposed to each other. However, it is also possible to realize a cantilever type of workpiece holding mechanism by one pair of workpiece holder 20.

Figure 10:
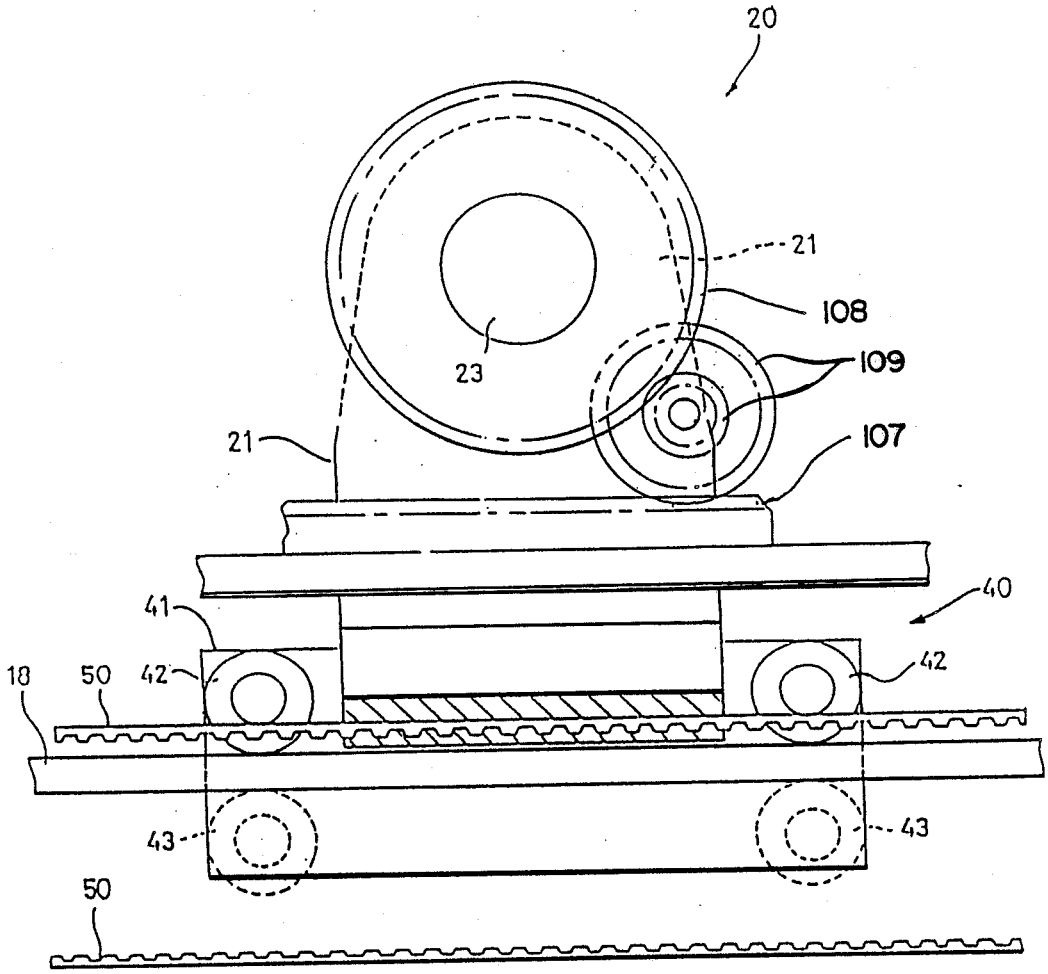
FIG. 10 is an enlarged longitudinal, partial sectional view of a further embodiment of the present invention.

Furthermore, in an alternative, as illustrated in FIG. 10, each workpiece rotating mechanism can have a rack 107 provided on the intermediate portion of the guide rail 87 and a pinion 108 which is provided on the hollow shaft 23 integral therewith. The racks can be engaged by the pinions when the workpiece holders 20 pass through the racks to rotate the hollow shafts 23 and accordingly the workpiece W. In this alternative, when the workpiece holders 20 move at a high speed, the hollow shafts 23 and accordingly the clamp arms 26 and the workpiece W commence rotating at a high acceleration and rotate at high speed. When the high speed rotation of the workpiece W takes place, the latter may be thrown out from the clamp arms 26, due to a shock or centrifugal force. To prevent this, a reduction gear 109 (not shown) can be provided between the racks and the hollow shafts 23 to reduce the rotational speed of the hollow shafts 23.

Although the workpiece clamping members are embodied by the clamp arms 26, and the clamp shafts 27 and 29, etc. and the clamp reversing members are embodied by the clamp reversing levers 32, the gears 35, the rollers 36, and the swing levers 37, etc. in the illustrated embodiments, they can be realized by other known mechanisms. It is also possible to use electromagnetic plungers or the like for the external actuating members 73.

As can be understood from the foregoing, according to the present invention, the movement and reverse of the workpiece can be effected while being held by the workpiece clamping members without disengaging the workpiece therefrom, and accordingly the conveyance speed can be increased. Furthermore, there is no possibility that the workpiece falls down from the clamping members and that the clamping position of the workpiece deviates between before and after the workpiece is clamped. The number of the tools for clamping the workpiece can be decreased. Since it is not necessary to connect conduits of the hydraulic cylinder devices or electrical cables or wires to the workpiece holders which move, the speed of the movement of the workpiece holders can be increased. In addition to the foregoing, there is not a possibility that the conduits or the cables catch operator's legs or another machine.

Furthermore, since the angular displacement and the displacement of conveyance, of the workpiece, and the position of the commencement of the rotation of the workpiece can be optionally selected, it is possible to prevent the workpiece from interferring with another machine, such as a loader or unloader, which may be located in the travel of the workpiece.

I claim:

1. An apparatus for conveying a workpiece, comprising:

at least one guide rail which extends between a workpiece receiving position and a workpiece discharging position of said apparatus;

at least one carrier which is movably supported by and along at least one of said at least one guide rail;

means for reciprocally moving said at least one carrier along said at least one guide rail;

at least one workpiece holder having a rotational shaft and which is supported by a respective one of said at least one carrier, said at least one workpiece holder further comprising at least one workpiece clamping mechanism which is movable between a workpiece clamping position and a workpiece releasing position;

at least one timing belt which extends substantially between opposite ends of a respective one of said at least one guide rail and which is further in functional engagement with said rotational shaft of a respective one of said at least one workpiece holder;

means for driving said at least one timing belt for movement; and means for moving said at least one workpiece clamping mechanism to its said workpiece clamping position upon receiving said workpiece at said workpiece receiving position of said apparatus and for moving said at least one workpiece clamping mechanism to its said workpiece releasing position for discharging said workpiece at said workpiece discharging position of said apparatus.

2. An apparatus according to claim 1, wherein said at least one guide rail comprises a pair of substantially parallel guide rails, said at least one carrier comprises a carrier movably supported by each of said pair of guide rails, said at least one workpiece holder comprises a workpiece holder carried by each of said carriers, and said at least one workpiece clamping mechanism comprises a workpiece clamping mechanism supported by each of said workpiece holders, whereby said workpiece clamping mechanisms substantially oppose each other.

3. An apparatus according to claim 2, further comprising means for adjusting the distance between said pair of substantially parallel guide rails.

4. An apparatus according to claim 1, further comprising means for elevating said at least one guide rail to adjust the heights of said workpiece receiving position and said workpiece discharging position of said apparatus.

5. An apparatus according to claim 1, wherein said means for reciprocally moving said at least one carrier comprises a second timing belt connected to a respective carrier and which extends substantially between opposite ends of a respective rail, and means for driving said second timing belt for moving said respective carrier.

6. An apparatus for conveying a workpiece, comprising:

at least one guide rail which extends between a workpiece receiving position and a workpiece discharging position of said apparatus;

at least one carrier which is movably supported by and along at least one of said at least one guide rail;

means for reciprocally moving said at least one carrier along said at least one guide rail;

at least one workpiece holder having a rotational shaft and which is supported by a respective one of said at least one carrier, said at least one workpiece holder further comprising at least one workpiece clamping mechanism which is movable between a workpiece clamping position and a workpiece releasing position;

at least one spline shaft extending substantially parallel with a respective one of said at least one guide rail;

at least one gear which is spline-engaged with a respective one of said at least one spline shaft, said at least one gear being functionally engaged with a respective one of said rotational shafts, whereby said at least one spline shaft and a respective one of said at least one gear comprise means for rotating said rotational shaft of said at least one workpiece holder; and means for moving said at least one workpiece clamping mechanism to its said workpiece clamping position upon receiving said workpiece at said workpiece receiving position of said apparatus and for moving said at least one workpiece clamping mechanism to its said workpiece releasing position for discharging said workpiece at said workpiece discharging position of said apparatus.

7. An apparatus according to claim 6, wherein said at least one guide rail comprises a pair of substantially parallel guide rails, said at least one carrier comprises a carrier movably supported by each of said pair of guide rails, said at least one workpiece holder comprises a workpiece holder carried by each of said carriers, and said at least one workpiece clamping mechanism comprises a workpiece clamping mechanism supported by each of said workpiece holders, whereby said workpiece clamping mechanisms substantially oppose each other.

8. An apparatus according to claim 7, further comprising means for adjusting the distance between said pair of substantially parallel guide rails.

9. An apparatus according to claim 6, further comprising means for elevating said at least one guide rail to adjust the heights of said workpiece receiving position and said workpiece discharging position of said apparatus.

10. An apparatus according to claim 6, wherein said means for reciprocally moving said at least one carrier comprises a timing belt connected to a respective carrier and which extends substantially between opposite ends of a respective rail, and means for driving said timing belt for moving said respective carrier.

11. An apparatus for conveying a workpiece, comprising:

at least one guide rail which extends between a workpiece receiving position and a workpiece discharging position of said apparatus;

at least one carrier which is movably supported by and along at least one of said at least one guide rail;

means for reciprocally moving said at least one carrier along said at least one guide rail;

at least one workpiece holder having a rotational shaft and which is supported by a respective one of said at least one carrier, said at least one workpiece holder further comprising at least one workpiece clamping mechanism which is movably between a workpiece clamping position and a workpiece releasing position;

at least one rack extending substantially parallel with a respective one of said at least one guide rail;

at least one pinion which is to be functionally engaged with a respective one of said at least one rack, said at least one pinion further being functionally engaged with a respective one of said rotational shafts, whereby said at least one rack and a respective one of said at least one pinion comprise means for rotating said rotational shaft of said at least one workpiece holder; and means for moving said at least one workpiece clamping mechanism to its said workpiece clamping position upon receiving said workpiece at said workpiece receiving position of said apparatus and for moving said at least one workpiece clamping mechanism to its said workpiece releasing position for discharging said workpiece at said workpiece discharging position of said apparatus.

12. An apparatus according to claim 11, wherein said at least one guide rail comprises a pair of substantially parallel guide rails, said at least one carrier comprises a carrier movably supported by each of said pair of guide rails, said at least one workpiece holder comprises a workpiece holder carried by each of said carriers, and said at least one workpiece clamping mechanism comprises a workpiece clamping mechanism supported by each of said workpiece holders, whereby said workpiece clamping mechanisms substantially oppose each other.

13. An apparatus according to claim 12, further comprising means for adjusting the distance between said pair of substantially parallel guide rails.

14. An apparatus according to claim 11, further comprising means for elevating said at least one guide rail to adjust the heights of said workpiece receiving position and said workpiece discharging position of said apparatus.

15. An apparatus according to claim 11, wherein said means for reciprocally moving said at least one carrier comprises a timing belt connected to a respective carrier and which extends substantially between opposite ends of a respective rail, and means for driving said timing belt for moving said respective carrier.

16. An apparatus for conveying a workpiece, comprising:

at least one guide rail which extends between a workpiece receiving position and a workpiece discharging position of said apparatus;

at least one carrier which is movably supported by and along at least one of said at least one guide rail;

means for reciprocally moving said at least one carrier along said at least one guide rail;

at least one workpiece holder having a rotational shaft and which is supported by a respective one of said at least one carrier, said at least one workpiece holder further comprising at least one workpiece clamping mechanism which is movable between a workpiece clamping position and a workpiece releasing position;

means for rotating said rotational shaft of said at least one workpiece holder;

means for moving said at least one workpiece clamping mechanism to its said workpiece clamping position upon receiving said workpiece at said workpiece receiving position of said apparatus and for moving said at least one workpiece clamping mechanism to its said workpiece releasing position for discharging said workpiece at said workpiece discharging position of said apparatus; and means for elevating said at least one guide rail for adjusting the respective heights of said workpiece receiving position and said workpiece discharging position of said apparatus, said elevating means comprising at least one lifting mechanism for said receiving position of said apparatus and at least one lifting mechanism for said discharging position of said apparatus, and means at an intermediate portion of said one guide rail for restricting movement of said elevating means, and about which said at least one guide rail effectively rotates.

17. An apparatus of claim 16, wherein said elevating means comprises an elevating frame upon which said at least one guide rail is effectively supported, whereby said movement restricting means comprises at least one support, and wherein said lifting mechanisms are operable to raise and lower said elevating frame about said support to maintain said elevating frame substantially horizontal or inclined.

18. An apparatus for conveying a workpiece comprising:

(a) at least one workpiece holder movably between a workpiece receiving position and a workpiece discharging position, said at least one workpiece holder comprising a workpiece clamping mechanism movable between a workpiece clamping position and a workpiece releasing position;

(b) a clamp reversing device for each said at least one workpiece holder for movement therewith between said receiving position and said discharging position, said clamp reversing device being actuable for moving said workpiece clamping mechanism between said workpiece clamping position and said workpiece releasing position; and (c) means for actuating each said clamp reversing device by engagement therewith, said means for actuating said clamp reversing device comprising a driven member for engaging said clamp reversing device and being located at each of said workpiece receiving position of said apparatus and said workpiece discharging position of said apparatus.

19. An apparatus according to claim 18, wherein said workpiece clamping mechanism comprises clamping members rotatably supported by at least one rotational shaft, and wherein said apparatus further comprises means for functionally engaging said at least one rotational shaft for rotating and controlling said clamping members.

20. An apparatus for conveying a workpiece comprising:

(a) at least one workpiece holder movable between a workpiece receiving position and a workpiece discharging position, said at least one workpiece holder comprising a workpiece clamping mechanism movable between a workpiece clamping position and a workpiece releasing position, wherein said workpiece clamping mechanism comprises a hollow rotational shaft, clamp arms functionally connected to said hollow rotational shaft for rotational movement therewith and pivotal movement relative thereto, at least one clamp shaft slidably mounted within said hollow rotational shart, and a toggle mechanism connecting said clamp arms to said at least one clamp shaft, wherein said clamp reversing device comprises a clamp reversing lever functionally connected to said at least one clamp shaft for moving said clamping mechanism between said workpiece clamping position and said workpiece releasing position;

(b) a clamp reversing device for each said at least one workpiece holder for movement therewith between said receiving position and said discharging position, said clamp reversing device being actuable for moving said workpiece clamping mechanism between said workpiece clamping position and said workpiece releasing position; and (c) means for actuating each said clamp reversing device by engagement therewith, said means for actuating said clamp reversing device being located at each of said workpiece receiving position of said apparatus and said workpiece discharging position of said apparatus.

21. An apparatus according to claim 20, wherein said at least one clamp shaft comprises a first clamp shaft connected to said toggle mechanism and a second clamp shaft functionally connected to said clamp reversing lever, further comprising a coil spring connecting said first clamp shaft to said second clamp shaft.

22. An apparatus according to claim 20, further comprising means functionally connected between said clamp reversing lever and said at least one clamp shaft for preventing said at least one clamp shaft from moving in a direction for movement of said clamping mechanism into said workpiece releasing position.

23. An apparatus according to claim 18, further comprising means for moving said at least one workpiece holder between said workpiece receiving position and said workpiece discharging position.

24. An apparatus according to claim 23, wherein said means for moving said at least one workpiece holder between said workpiece receiving position and said workpiece discharging position comprises a timing belt extending substantially between said workpiece receiving position and said workpiece discharging position of said apparatus and being functionally engaged with said a respective workpiece holder.

25. An apparatus for conveying a workpiece comprising:

(a) at least one workpiece holder movable between a workpiece receiving position and a workpiece discharging position, said at least one workpiece holder comprising a workpiece clamping mechanism movable between a workpiece clamping position and a workpiece releasing position, wherein said workpiece clamping mechanism comprises clamping members rotatably supported by at least one rotational shaft, and wherein said apparatus further comprises means for functionally engaging said at least one rotational shaft for rotating and controlling said clamping members, wherein said means for rotating and controlling said clamping members comprises (i) at least one timing belt which extends substantially between said workpiece receiving position of said apparatus and said workpiece discharging position of said apparatus, said at least one timing belt being in functional engagement with said at least one rotational shaft, and (ii) means for driving said at least one timing belt for movement;

(b) a clamp reversing device for each said at least one workpiece holder for movement therewith between said receiving position and said discharging position, said clamp reversing device being actuable for moving said workpiece clamping mechanism between said workpiece clamping position and said workpiece releasing position; and (c) means for actuating each said clamp reversing device by engagement therewith, said means for actuating said clamp reversing device being located at each of said workpiece receiving position of said apparatus and said workpiece discharging position of said apparatus.

26. An apparatus for conveying a workpiece comprising:

(a) at least one workpiece holder movable between a workpiece receiving position and a workpiece discharging position, said at least one workpiece holder comprising a workpiece clamping mechanism movable between a workpiece clamping position and a workpiece releasing position, wherein said workpiece clamping mechanism comprises clamping members rotatably supported by at least one rotational shaft, and wherein said apparatus further comprises means for functionally engaging said at least one rotational shaft for rotating and controlling said clamping members, wherein said means for rotating and controlling said clamping members comprises (i) at least one spline shaft which extends substantially between said workpiece receiving position of said apparatus and said workpiece discharging position of said apparatus, (ii) at least one gear which is spline-engaged with a respective one of said at least one spline shaft, said at least one gear being functionally engaged with a respective one of said at least one rotational shaft, and (iii) means for rotatably driving said at least one spline shaft;

(b) a clamp reversing device for each said at least one workpiece holder for movement therewith between said receiving position and said discharging position, said clamp reversing device being actuable for moving said workpiece clamping mechanism between said workpiece clamping position and said workpiece releasing position; and (c) means for actuating each said clamp reversing device by engagement therewith, said means for actuating said clamp reversing device being located at each of said workpiece receiving position of said apparatus and said workpiece discharging position of said apparatus.

27. An apparatus for conveying a workpiece comprising:

(a) at least one workpiece holder movable between a workpiece receiving position and a workpiece discharging position, said at least one workpiece holder comprising a workpiece clamping mechanism movable between a workpiece clamping position and a workpiece releasing position, wherein said workpiece clamping mechanism comprises clamping members rotatably supported by at least one rotational shaft, and wherein said apparatus further comprises means for functionally engaging said at least one rotational shaft for rotating and controlling said clamping members, wherein said means for rotating and controlling said clamping members comprises (i) at least one rack which is located substantially between said workpiece receiving position of said apparatus and said workpiece discharging position of said apparatus, and (ii) at least one pinion which is functionally engaged with a respective one of said at least one rotational shaft, and which is functionally engaged by said at least one rack during movement of said apparatus between said workpiece receiving position and said workpiece discharging position;

(b) a clamp reversing device for each said at least one workpiece holder for movement therewith between said receiving position and said discharging position, said clamp reversing device being actuable for moving said workpiece clamping mechanism between said workpiece clamping position and said workpiece releasing position; and (c) means for actuating each said clamp reversing device by engagement therewith, said means for actuating said clamp reversing device being located at each of said workpiece receiving position of said apparatus and said workpiece discharging position of said apparatus.

28. An apparatus according to claim 27, further comprising gear reduction between said at least one rack and said at least one pinion.

29. An apparatus according to claim 28, wherein said means for actuating said clamp reversing device comprises a driven member which engages a portion of said clamp reversing device at said workpiece receiving position for movement of said workpiece clamping mechanism to said workpiece clamping position and which engages said portion of said clamp reversing device at said workpiece discharging position for movement of said workpiece clamping mechanism to said workpiece releasing position.

30. An apparatus according to claim 29, wherein said driven member comprises a hydraulic cylinder actuated device.

31. An apparatus according to claim 18, wherein said driven member comprises a hydraulic cylinder actuated device.

* * * * *

UNITED STATES PATENT AND TRADEMARK OFFICE

CERTIFICATE OF CORRECTION

PATENT NO. : 4,893,982

DATED : January 16, 1990

INVENTOR(S) : Takaharu YAMAGUCHI

It is certified that error appears in the above-identified patent and that said Letters Patent is hereby corrected as shown below:

column 3, line 21, change "work" to ---workpiece---;
column 4, line 60, change "27" to ---28--- after "plates";
column 4, line 62, change "29" to ---22--- after "pulley";
column 6, line 33, change "&he" to ---the---;
column 8, line 16, change "revering" to ---reversing---;

column 8, line 38, change "moves" to ---move---;
column 10, line 20, delete "(not shown)"; and
column 14, line 50 (claim 20, line 14), change "shart" to ---shaft---.

Signed and Sealed this

Sixth Day of August, 1991

*Attest:*

*Attesting Officer*

HARRY F. MANBECK, JR.

*Commissioner of Patents and Trademarks*